US006679222B1

(12) United States Patent
Reischl et al.

(10) Patent No.: US 6,679,222 B1
(45) Date of Patent: Jan. 20, 2004

(54) METHOD OF METERING FUEL USING A FUEL INJECTOR

(75) Inventors: Rolf Reischl, Stuttgart (DE); Wolfgang Ruehle, Ditzingen (DE); Hubert Stier, Asperg (DE); Matthias Boee, Ludwigsburg (DE); Norbert Keim, Loechgau (DE); Guenther Hohl, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 10/049,008

(22) PCT Filed: Aug. 3, 2000

(86) PCT No.: PCT/DE00/02620

§ 371 (c)(1),
(2), (4) Date: Jun. 10, 2002

(87) PCT Pub. No.: WO01/11228

PCT Pub. Date: Feb. 15, 2001

(30) Foreign Application Priority Data

Aug. 5, 1999 (DE) ..... 199 36 944

(51) Int. Cl.[7] ..... F02M 51/00

(52) U.S. Cl. ..... 123/305; 123/672; 123/673; 123/490; 701/109

(58) Field of Search ..... 123/305, 672, 123/673, 490, 478; 701/109

(56) References Cited

U.S. PATENT DOCUMENTS 4,649,886 A 3/1987 Sakakibara et al.
4,732,129 A 3/1988 Sakakibara et al.
4,798,188 A 1/1989 Ito et al.
5,479,902 A * 1/1996 Wirbeleit et al. ..... 123/498
5,740,777 A 4/1998 Ando et al.
5,983,853 A * 11/1999 Roessler et al. ..... 123/295

FOREIGN PATENT DOCUMENTS

| | | |
|---|---|---|
| DE | 40 05 455 | 8/1990 |
| DE | 196 42 653 | 1/1998 |
| EP | 0 856 654 | 8/1998 |
| EP | 0 971 119 | 1/2000 |
| FR | 2 754 564 | 4/1998 |

* cited by examiner

*Primary Examiner*—Erick Solis
(74) *Attorney, Agent, or Firm*—Kenyon & Kenyon

(57) ABSTRACT

A method of metering fuel with a fuel injector, in particular a fuel injector for fuel injection systems in internal combustion engines is described, having a piezoelectric or magnetostrictive actuator and a valve closing body which is operable by the actuator with a valve lift, cooperating with a valve seat face provided on a valve seat body to form a sealing seat. The valve lift may be adjusted variably as a function of a variable control signal triggering an actuator to produce a variable fuel flow at the sealing seat. To produce afitted curve, the fuel flow of the fuel jet sprayed by the fuel injector is measured as a function of the control signal to produce a fitted curve, and a predetermined fuel flow is set with the control signal by using the fitted curve.

14 Claims, 3 Drawing Sheets

METHOD OF METERING FUEL USING A FUEL INJECTOR

FIELD OF THE INVENTION

The present invention relates to a fuel injector.

BACKGROUND INFORMATION

German Patent No. 196 42 653 describes a method of metering fuel with a fuel injector. Optimal adjustment parameters for the valve lift of a valve closing body and the injection time are stored in an injection characteristics map for each operating point of the internal combustion engine determined by the rotational speed and the load. In reaching any desired operating point of the internal combustion engine, the corresponding adjustment parameters obtained from the injection characteristics map are used by a control circuit to adjust the valve lift and the injection time for operation of the internal combustion engine. The running smoothness of the internal combustion engine is then measured and compared with an operating point-specific setpoint. If there is a deviation from the setpoint, a regulation unit causes the adjustment parameters to be varied until stabilization of smooth running of the internal combustion engine at the setpoint has been achieved. The adjustment parameters used as the basis for achieving the setpoint are then stored as new optimized values at the operating point in the injection characteristics map, replacing the previous adjustment parameters.

The method described in German Patent No. 196 42 653 for metering fuel with a fuel injector has the disadvantage that the internal combustion engine must first be broken in in order to compile the injection characteristics map. Optimization of the valve lift and injection time depends to a significant extent on the setpoints of the regulation unit, so that under some circumstances an ideal operating point is not achieved. In addition, when running smoothness of the internal combustion engine declines due to aging because of a deviation, which is measured but does not depend on the adjustment parameters, in the running smoothness of the internal combustion engine from a setpoint, deregulation of the adjustment parameters may occur at the operating point of the internal combustion engine. Furthermore, the running smoothness of the internal combustion engine depends on numerous factors such as the composition and temperature of the air supplied and the engine temperature, so that preselecting setpoints to be allocated to the injection characteristics map represents a problem.

Another disadvantage is that for each combination of rotational speed and load, both the valve lift and the injection time must be stored, which requires a high storage capacity in a nonvolatile memory.

German Published Patent Application No. 40 05 455 describes a fuel injector having a piezoelectric actuator and a valve closing body operable by an actuator having a valve lift cooperating with a valve seat face provided on a valve seat carrier to form a sealing seat. To open the sealing seat, a voltage is applied to the actuator, and to close the sealing seat, the voltage is switched off. The fuel injector has a fuel intake connection piece through which fuel is conveyed into the fuel injector. Fuel conveyed into the fuel injector is acted upon by a fuel intake pressure using a fuel pump.

The following disadvantages occur with the fuel injector described in German Published Patent Application No. 40 05 455. To inject a maximum quantity of fuel, which is necessary for full-load operation of the internal combustion engine, a high fuel intake pressure is necessary at the given lift of the valve needle and a given maximum switching time. To reduce the quantity of fuel injected by the fuel injector, the switching time of the fuel injector may be shortened first. Since fuel is also sprayed out of the fuel injector during the opening and closing operation, delivery of fuel is unreproducible in the event of short switching times on the order of magnitude of the opening and closing times of the fuel injector. For extremely small quantities of fuel, which are necessary in idling, for example, it is therefore no longer possible to adjust the quantity of dispensed fuel through the switching time. To be able to dispense a required minimal quantity, the fuel intake pressure must therefore be lowered. This situation is especially problematical in supercharged engines, because extremely low switching times are required due to the short maximum injection time, and nevertheless it may be necessary to reduce the pressure.

Another disadvantage is that the cone vertex angle of the injected fuel jet is determined by the geometry of the seat and cannot be altered during operation of the fuel injector.

SUMMARY OF THE INVENTION

The method according to the present invention for metering fuel using a fuel injector has the advantage over the related art that by determining the fuel flow as a function of several settings of the control signal, a fitted curve characterizing the design of the fuel injector is obtained, so that when using the fitted curve, any desired fuel flow may be adjusted using the control signal. By integration of fuel flow over injection time, the quantity of fuel sprayed by the fuel injector may be determined. Thus, at each operating point of the internal combustion engine, a preselected fuel flow may be set by the control signal. It is therefore possible to set a setpoint directly without requiring a special regulation. In addition, it is readily possible to compensate for engine-specific fluctuations.

It is advantageous that by varying the control signal, a cone vertex angle of a fuel jet sprayed by the fuel injector is varied. This makes it possible to preselect the spatial area in which fuel is mixed thoroughly with combustion air.

It is advantageous that the cone vertex angle of the fuel jet sprayed by the fuel injector is measured as a function of the control signal for generating a characteristic curve, and that by using this characteristic curve, a predetermined cone vertex angle of the fuel jet is set with the control signal. This makes it possible to directly adjust a setpoint of the cone vertex angle without requiring any special regulation, and in addition, it is readily possible to compensate for engine-specific fluctuations.

In an advantageous manner, fuel supplied to the fuel injector is acted upon by a fuel intake pressure which is at least approximately constant over time. This simplifies control of the fuel injector.

It is also advantageous if fuel is injected directly into a combustion chamber of an internal combustion engine and if the control signal is influenced by at least one controlled variable of the internal combustion engine. This controlled variable may be, for example, the torque or the rotational speed of the internal combustion engine, or the controlled variable may depend on the composition of the exhaust gas generated by the internal combustion engine. This makes it possible to achieve cylinder balancing and optimization of engine performance. Likewise, long-term drift of the fuel injector may also be compensated. It is especially advantageous if the controlled variable is determined individually for each individual cylinder of the internal combustion engine, so it is possible to rapidly detect a difference in performance of the individual cylinders.

DETAILED DESCRIPTION

Figure 1:
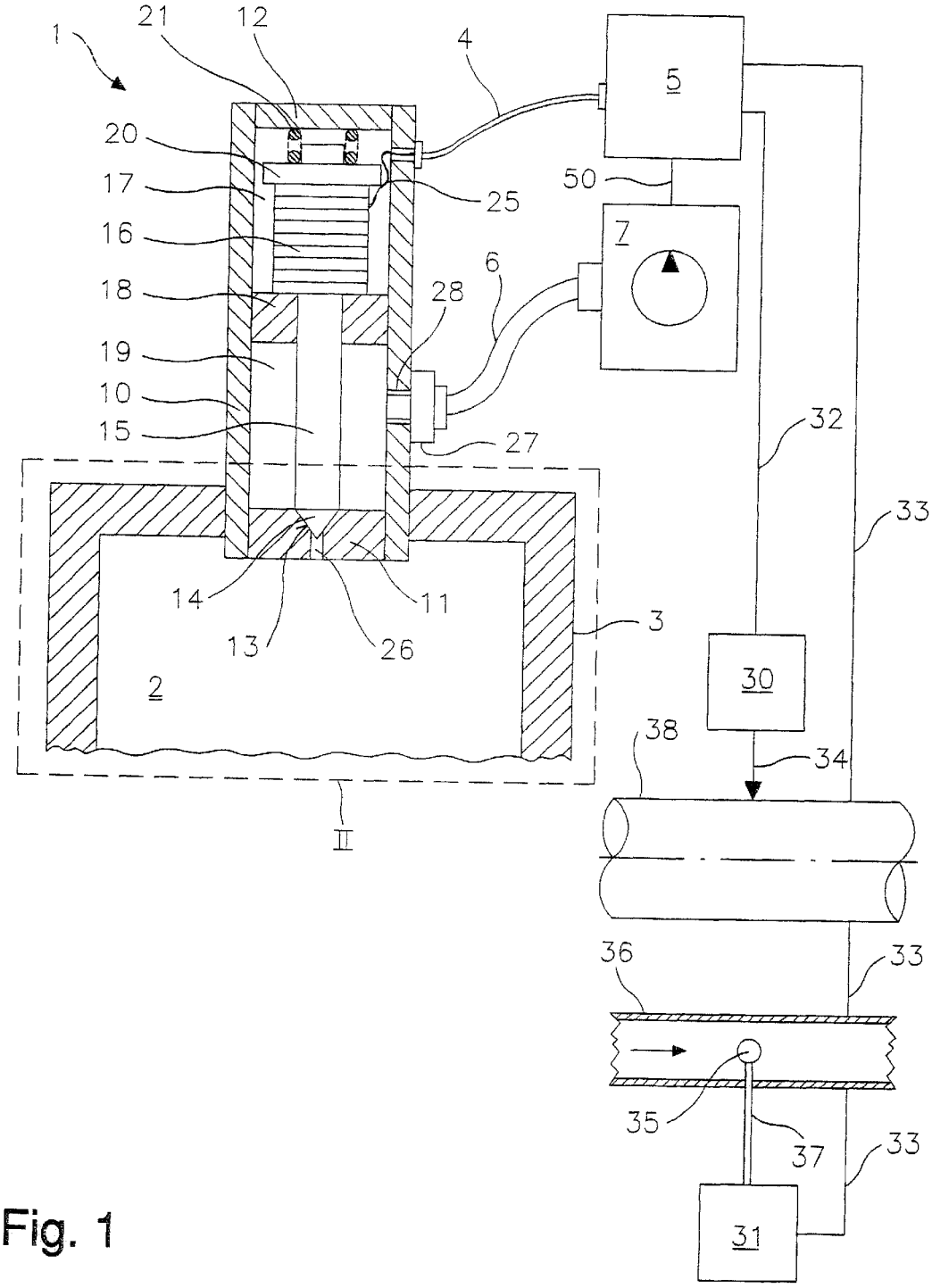
FIG. 1 shows a schematic embodiment to illustrate the method according to the present invention.

FIG. 1 shows an arrangement to illustrate the method according to the present invention for metering fuel with a fuel injector 1. Fuel injector 1 is designed here as an inward opening fuel injector 1, but this method is also suitable for an outward opening fuel injector 1. In this embodiment, fuel injector 1 is used for direct injection of fuel, in particular gasoline, into a combustion chamber 2 of an internal combustion engine 3 having compression of a fuel mixture with spark ignition as a direct gasoline injector. However, fuel injector 1 according to the present invention is also suitable for other applications.

Fuel injector 1 is connected to a control unit 5 by an electric cable 4. In addition, fuel injector 1 is connected to a fuel pump 7 by a fuel line 6.

Valve housing 10 of fuel injector 1 has a valve seat body 11 on one end; on the other end, valve housing 10 is sealed with a valve cover 12. A valve seat face 13 is formed in valve seat body 11 and cooperates with a valve closing body 14 in the form of a truncated cone tapering in the direction of spray to form a valve seat and it is operated by a valve needle 15, and in the embodiment illustrated here, it is designed in one piece with it.

Fuel injector 1 is actuated by an actuator 16 designed as a piezoelectric or magnetostrictive actuator. Actuator 16 has a central recess through which valve needle 15 penetrates so that actuator 16 surrounds valve needle 15 at least in some sections. Actuator 16 is situated in an actuator space 17 separated by a sealing plate 18 from a fuel space 19. Valve needle 15 is connected to a pressure plate 20. Actuator 16 is supported at one end on pressure plate 20 and at the other end on sealing plate 18. In addition, sealing plate 18 provides guidance for valve needle 15. Valve closing body 14 is pressed, by a compression spring 21, via valve needle 15 and pressure plate 20 into valve seat face 13 of valve seat body 11, thus closing the sealing seat.

Fuel injector 1 is operated by a control signal generated by control unit 5 and sent over electric cable 4 and electric lead 25 to actuator 16. When actuator 16 is actuated, it expands against the force of compressive spring 21, thus generating a valve lift of valve needle 15 and causing valve closing body 14 to be lifted up from valve seat face 13. Fuel escapes from fuel space 19 into a spray channel 26 through the resulting gap between valve closing body 14 and valve seat face 13, so that fuel is injected into combustion chamber 2 of internal combustion engine 3.

Fuel is fed into fuel space 19 through fuel line 6 and fuel pump 7. Fuel pump 7 provides a variable adjustment of the fuel intake pressure prevailing in fuel space 19. Fuel line 6 is connected to valve housing 10 of fuel injector 1 via a connecting element 27 by a thread 28.

Fuel pump 7 is connected to a fuel tank (not shown) from which it pumps fuel into fuel space 19.

By actuating actuator 16 via control unit 5, a valve needle lift of valve needle 15 is produced, resulting in a gap between valve closing body 14 and valve seat face 13, its cross-sectional area depending on the size of the valve needle lift. A fuel jet is sprayed from fuel injector 1 through the resulting gap. The sprayed jet of fuel is characterized by a fuel flow based on the quantity of fuel discharged over time. The quantity of fuel injected during one actuation cycle of fuel injector 1 is therefore obtained from the fuel flow integrated over the injection cycle.

To operate internal combustion engine 3 in homogeneous operation, a certain required amount of air is used for the amount of fuel injected, this amount of air being just sufficient to completely burn the quantity of fuel present. For homogeneous operation of internal combustion engine 3, however, ideal mixing of fuel and air is desirable, so that it is often more favorable to operate internal combustion engine 3 in lean operation, i.e., the amount of air present in combustion chamber 2 of internal combustion engine 3 is greater than the amount of air required. In particular, if only a small amount of air is available, fuel injector 1 is triggered so that only a small quantity of fuel is dispensed.

To inject a small quantity of fuel into combustion chamber 2 of internal combustion engine 3 with no change in the fuel intake pressure of fuel in fuel space 19, actuator 16 is triggered with a variable control signal so that fuel injector 1 opens only partially. The resulting opening cross section between valve closing body 14 and valve seat face 13 of valve seat body 11 may then be kept constant for a certain period of time, after which the sealing seat is closed again by the control signal. In this way, even very small quantities of fuel may be injected into combustion chamber 2. These small quantities of fuel may also be metered at a constant fuel intake pressure which is generated by fuel pump 7 in fuel space 19. Therefore, it is possible merely by varying the control signal generated by control unit 5 to produce a fuel flow which is variable continuously from zero up to a maximum value, so that the quantity of fuel injected into combustion chamber 2 may be adjusted in a reproducible manner. The maximum fuel flow is determined by the fuel intake pressure, the seat geometry, and the maximum valve lift.

To influence the control of fuel injected into combustion chamber 2 of internal combustion engine 3 through controlled variables of internal combustion engine 3, control unit 5 is connected to a drive shaft measurement device 30 and an exhaust gas measurement device 31, for which purpose connections 32, 33 are provided. Drive shaft measurement device 30 is connected to a drive shaft sensor 34 which measures the torque and/or rotational speed of the internal combustion engine. Fluctuations in torque correlated with the number of revolutions are used to derive information regarding the combustion conditions in the individual cylinders of internal combustion engine 3. Drive shaft sensor 34 may engage with drive shaft 38 or it may also engage with another device suitable for determining the torque or the rotational speed of the internal combustion engine. Exhaust gas measurement device 31 has an exhaust gas sensor 35 which is introduced into an exhaust gas line 36 of internal combustion engine 3. Exhaust gas sensor 35 is connected by a connecting piece 37 to exhaust gas measurement device 31. Exhaust gas sensor 35 may be situated upstream from the point where the exhaust gases generated by the individual cylinders of internal combustion engine 3 are combined or downstream from the point where the combustion gases generated by the individual cylinders of internal combustion engine 3 are combined.

Controlled variables generated by drive shaft measurement device 30 and exhaust gas measurement device 31 are sent over connections 32, 33 to control unit 5 and are processed further as part of an engine control unit. Therefore, the cylinders may be adjusted to one another through a control that is individual for each cylinder; likewise, long-term drift of the injection performance of fuel injector 1 may also be corrected.

Figure 2:
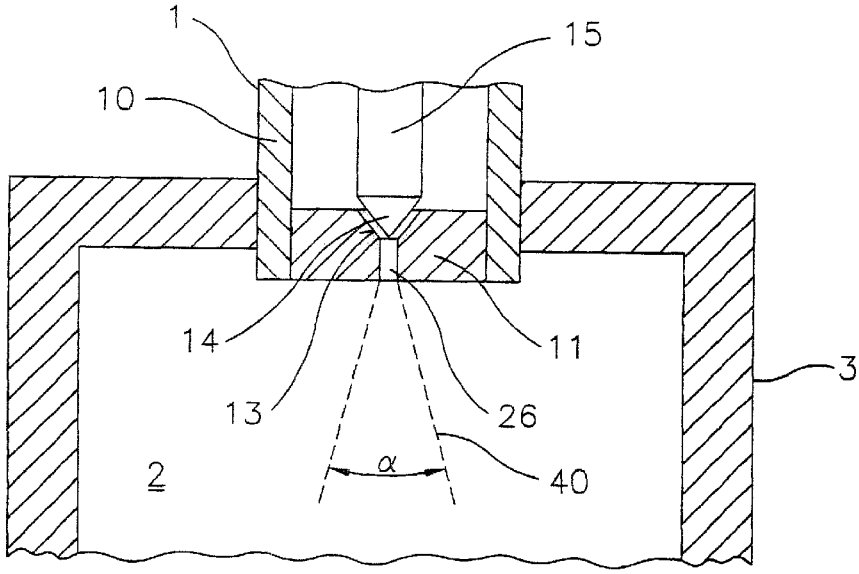
FIG. 2 shows detail II in FIG. 1 for a first operating setting.
Figure 3:
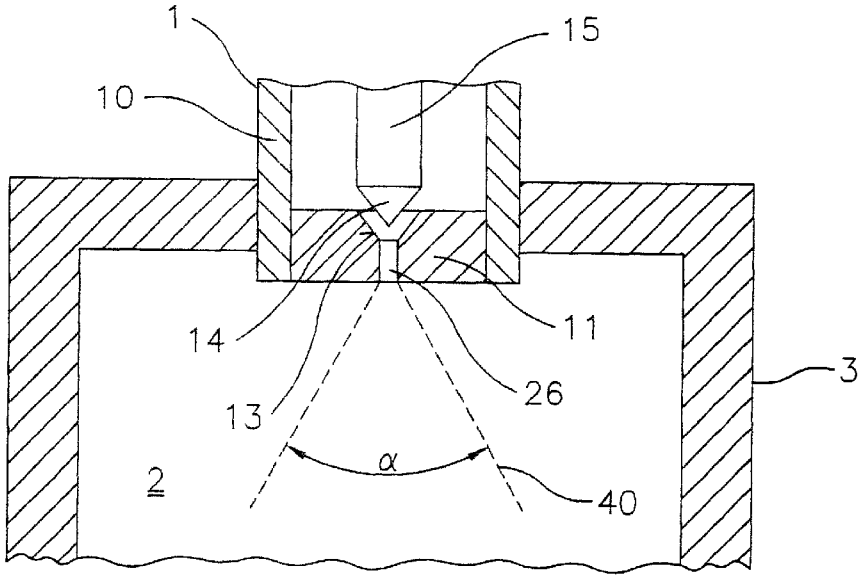
FIG. 3 shows detail II in FIG. 1 for a second operating setting.

FIGS. 2 and 3 show the detail labeled as II in FIG. 1, where fuel injectors 1 are controlled differently. Elements that have already been described are labeled with the same reference notation. With a valve lift of fuel injector 1, a fuel flow is created at the sealing seat formed by valve closing body 14 and valve seat face 13, so that a fuel jet 40 in the form of a truncated cone is sprayed out of spray channel 26 of fuel injector 1. Fuel jet 40 has a cone vertex angle a which depends on the fuel flow rate.

In FIG. 3 a larger valve needle lift is adjusted through the control signal than in FIG. 2, so the fuel flow is increased and a larger cone vertex angle a of conical fuel jet 40 is achieved.

By varying the control signal, it is therefore possible to vary cone vertex angle a of fuel jet 40 sprayed by fuel injector 1.

Figure 4:
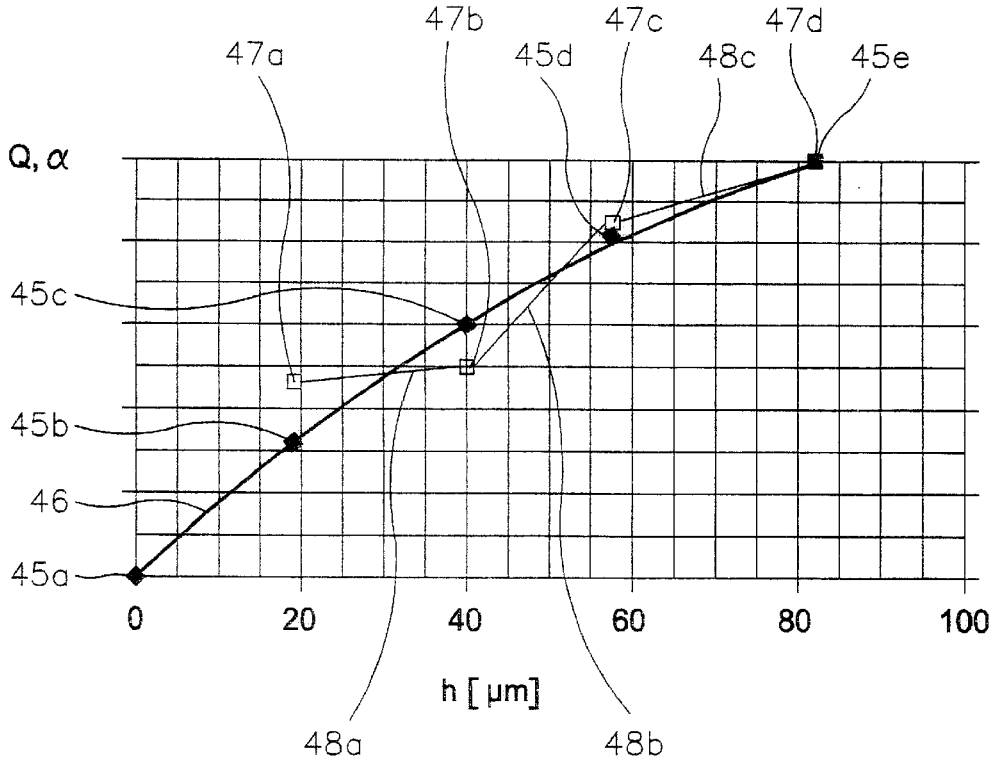
FIG. 4 shows a diagram to illustrate the method according to the present invention.

FIG. 4 shows a measurement series illustrating fuel flow Q and cone vertex angle a of fuel jet 40 as a function of a valve lift h of fuel injector 1. Valve lift h is obtained here due to the expansion of actuator 16 as a function of the control signal of control unit 5. Instead of valve lift h, the physical quantity, e.g., the electric voltage of the control signal, could be plotted on the abscissa. By varying the control signal, valve lift h is varied, resulting in a steady-state fuel flow Q after a short period of time for a fixed valve lift h. Steady-state fuel flow Q is indicated by the solid diamonds in the diagram shown here. At a valve lift h=0, a negligible fuel flow Q is obtained. At a valve lift of h=82$\mu$m, a maximum fuel flow Q is achieved in this embodiment. A fitted curve is drawn through measurement points 45*a*–45*e*; such a curve may represent a second-degree polynomial, for example. However, the fitted curve may also be obtained by connecting two adjustment measurement points, e.g., 45*b*, 45*c* by a straight-line segment. Then with the help of fitted curve 46, required valve lift h or the required size of the control signal may be determined for a certain fuel flow Q. To adjust predetermined fuel flow Q at fuel injector 1, a control signal of the quantity thus determined is sent to fuel injector 1, so that desired fuel flow Q at fuel injector 1 is set. This calibration and control algorithm may be implemented with a microprocessor in control unit 5.

In the same way, cone vertex angle $\alpha$ is determined as a function of valve lift h or the magnitude of the control signal. In the embodiment illustrated here, this yields measurement points 47*a*–47*d*. Two adjacent measurement points such as 47*b*, 47*c* are connected by a straight-line segment, e.g., 48*a*, thus yielding characteristic line 48*a*–48*c*. As in the case of fuel flow Q, required valve lift h or the required magnitude of the control signal may be determined with the help of characteristic curve 48*a*–48*c* at a desired cone vertex angle a, desired cone vertex angle a being determined by triggering fuel injector 1 with a corresponding control signal. The fitted curve and characteristic curve 46 and 48*a*–48*c* may also be determined by another method, in particular by interpolation or approximation.

To vary cone vertex angle a at a fixed fuel flow Q, the fuel intake pressure of the fuel may also be varied via fuel pump 7. This then yields a two-dimensional engine characteristics map in which fuel flow Q and cone vertex angle a are represented as a function of the valve lift and/or the magnitude of the control signal and the fuel intake pressure. Then, required valve lift h or the magnitude of the control signal and the required fuel intake pressure may be determined for a desired pairing of fuel flow and cone vertex angle (Q, $\alpha$). Fuel flow Q and cone vertex angle a may then be adjusted independently of one another by controlling fuel injector 1 and fuel pump 7. For this embodiment, control unit 5 is connected to fuel pump 7 by a connection 50 (FIG. 1).

The present invention is not limited to the embodiments described here. In particular, the present invention is also suitable for any desired fuel injectors 1 which permit a variable control of the valve lift.

What is claimed is:

1. A method of metering a fuel using a fuel injector with which the fuel is injected directly into a combustion chamber of an internal combustion engine, the fuel injector including one of a piezoelectric actuator and a magnetostrictive actuator, a valve closing body that is operable by the one of the piezoelectric actuator and the magnetostrictive actuator with a valve lift and that cooperates with a valve seat face provided on a valve seat body to form a sealing seat, the method comprising:

variably adjusting the valve lift as a function of a variable control signal triggering the one of the piezoelectric actuator and the magnetostrictive actuator to produce a variable fuel flow at the sealing seat;

measuring a fuel flow of a fuel jet sprayed by the fuel injector as a function of the variable control signal to produce a fitted curve; and setting a predetermined fuel flow with the variable control signal by using the fitted curve, wherein:

the variable control signal depends on at least one controlled variable of the internal combustion engine, and the at least one controlled variable depends on a composition of an exhaust gas generated by the internal combustion engine.

2. The method according to claim 1, further comprising:

causing a control unit connected to an exhaust gas measurement device to process the at least one controlled quantity in order to yield the variable control signal.

3. The method according to claim 2, further comprising:

introducing an exhaust gas sensor of the exhaust gas measurement device into an exhaust gas line of the internal combustion engine; and causing the at least one controlled variable of the internal combustion engine to be sent to the control unit from the exhaust gas sensor.

4. The method according to claim 2, further comprising:

equalizing individual combustion chambers of the internal combustion engine through the at least one controlled variable.

5. The method according to claim 1, further comprising:

varying the variable control signal in order to vary a cone vertex angle of the fuel jet sprayed by the fuel injector.

6. The method according to claim 5, further comprising:

measuring the cone vertex angle of the fuel jet as a function of the variable control signal to produce a characteristic curve; and setting a predetermined cone vertex angle of the fuel jet with the variable control signal by using the characteristic curve.

7. The method according to claim 1, wherein:

the fuel supplied to the fuel injector is under a fuel intake pressure which is at least approximately constant over time.

8. The method according to claim 1, further comprising:

determining the at least one controlled variable individually for each individual combustion chamber of the internal combustion engine.

9. A method of metering a fuel using a fuel injector with which the fuel is injected directly into a combustion chamber of an internal combustion engine, the fuel injector including one of a piezoelectric actuator and a magnetostrictive actuator, a valve closing body that is operable by the one of the piezoelectric actuator and the magnetostrictive actuator with a valve lift and that cooperates with a valve seat face provided on a valve seat body to form a sealing seat, the method comprising:

variably adjusting the valve lift as a function of a variable control signal triggering the one of the piezoelectric actuator and the magnetostrictive actuator to produce a variable fuel flow at the sealing seat;

measuring one of a fuel flow and a cone vertex of a fuel jet sprayed by the fuel injector as a function of the variable control signal to produce a fitted curve;

integrating the fuel flow over an injection time to determine a quantity of the fuel flow; and setting a predetermined fuel flow with the variable control signal by using the fitted curve.

10. The method according to claim 9, wherein for each fixed value of the valve lift, the variable control signal is varied to produce a steady-state flow and the fitted curve is produced by fitting a curve to approximate points of measured steady-state flow.

11. The method according to claim 10, wherein the curve represents a second-degree polynomial.

12. The method according to claim 9, wherein for each fixed value of the valve lift, the variable control signal is varied to produce a steady-state flow and the fitted curve is produced by connecting adjacent points of measured steady-state flow.

13. The method according to claim 9, wherein fitted curve is produced by varying a fuel intake pressure to vary the cone vertex at a fixed steady-state fuel flow.

14. The method according to claim 9, further comprising:

correcting a long-term drift of an injection performance of the fuel injector.

* * * * *